US005836273A

United States Patent [19]

Hair

[11] Patent Number: 5,836,273

[45] Date of Patent: Nov. 17, 1998

[54] RECIPROCATING MACHINE

[75] Inventor: Kelvin John Hair, Auckland, New Zealand

[73] Assignee: Qintessential Concepts Limited, Parnell, New Zealand

[21] Appl. No.: 836,570

[22] PCT Filed: Nov. 14, 1995

[86] PCT No.: PCT/NZ95/00118

§ 371 Date: Jul. 11, 1997

§ 102(e) Date: Jul. 11, 1997

[87] PCT Pub. No.: WO96/15355

PCT Pub. Date: May 23, 1996

[30] Foreign Application Priority Data

Nov. 14, 1994 [NZ] New Zealand ..... 264915

[51] Int. Cl.[6] ..... F01B 9/02; F02B 75/32

[52] U.S. Cl. ..... 123/52.4; 123/53.2; 123/197.4

[58] Field of Search ..... 123/52.2, 52.4, 123/53.2, 197.4

[56] References Cited

U.S. PATENT DOCUMENTS

| | | | |
|---|---|---|---|
| 1,585,796 | 5/1926 | Stahlberger | 123/53.2 |
| 3,521,615 | 7/1970 | Trammell | 123/53.2 |
| 4,690,113 | 9/1987 | Deland | 123/53.2 |
| 4,809,646 | 3/1989 | Paul et al. | 123/197.4 |
| 5,435,232 | 7/1995 | Hammerton | 123/197.4 |
| 5,595,147 | 1/1997 | Feuling | 123/52.4 |

FOREIGN PATENT DOCUMENTS

| | | |
|---|---|---|
| 0434116 | 6/1991 | European Pat. Off. . |
| 3322140 | 12/1984 | Germany . |
| 4013754 A | 10/1991 | Germany . |
| 57-171001 | 10/1982 | Japan . |
| 01-73102 | 3/1989 | Japan . |
| 92-095358/12 | 6/1991 | U.S.S.R. . |
| WO88/07129 | 9/1988 | WIPO . |
| WO91/05186 | 4/1991 | WIPO . |

*Primary Examiner*—David A. Okonsky
*Attorney, Agent, or Firm*—Jacobson, Price, Holman & Stern, PLLC

[57] ABSTRACT

A reciprocating machine includes a cyclical kinematic chain in which power is transferred between translational and rotational motion. The kinematic chain includes a piston (2) reciprocating in a cylinder (1), connected by two connecting rods (9, 10) to dual counter rotating crankshafts (7, 8). The crankshafts (7, 8) are displaced symmetrically from the axis of movement of the piston (2), and the crank pins (15, 16) of the crankshafts (7, 8) to which the connecting rods (9, 10) are connected are symmetrically aligned about the axis of movement of the piston (2). The connecting rod small ends (13, 14) abut at their connection to the piston (2). The distance between the axis of the dual crankshafts, the length of the connecting rods, the positioning of the connecting rods connections to the piston, and the diameter of rotation of the crank pins about the crankshaft axes are such that in motion the ratio of the length of each stroke of the piston to the diameter of rotation of the crank pins about the crankshaft axes is at least 1.1 to 1.

14 Claims, 7 Drawing Sheets

RECIPROCATING MACHINE

TECHNICAL FIELD

This invention relates to a reciprocating machine having a cyclical kinematic chain and has been devised particularly though not solely as a cylinder, reciprocating piston and rotary crank shaft assembly for use in an internal combustion engine (I.C.E.). It should be appreciated that this same technology may be applied to similar assemblies in hydraulic apparatus such as pumps and motors and other similar such means in addition to conventional use in combustion engines.

BACKGROUND ART

Reciprocating machines having cyclical kinematic chains described in previous patent specifications disclosing piston, cylinder and shaft assemblies for I.C.E., specifically U.S. Pat. No. 4,809,646, Japan 57-171001, Japan 01-73102 and Germany 4013754 have included dual crank shafts with dual connecting rods (conrods) one from each piston to a respective counter rotating crank shaft, the crank shafts being substantially equidistant from the centre line of travel of the piston. An advantage of such assemblies has been identified as a decrease in friction on the walls of the cylinder.

It is an object of the present invention to provide a reciprocating machine having a cyclical kinematic chain which at least provides the public with a useful choice.

DISCLOSURE OF THE INVENTION

Accordingly, the invention consists in a reciprocating machine including a cyclical kinematic chain in which power is transferred between translational and rotational motion said kinematic chain including a translational means cyclically reciprocatable along a line of motion through a first stroke between a first position and a second position and through a second stroke from said second position back to said first position, said kinematic chain having rotational means in the form of a pair of crank shafts having axes substantially symmetrically disposed on opposite sides of and normal to said line of motion of said translational means, said translational means having a pair of pivotal connecting means the axes of which are parallel and said axes in motion follow paths parallel to said line of motion, said crank shafts each having a crank pin the axis of which follows an orbital path of predetermined diameter in motion, a pair of connecting rods, each having a first end and a second end, the first end of each connecting rod being connected by pivotal connecting means through attaching means to said translational means, axes of said pivotal connecting means being disposed between said translational means and a line between the axes of said crank shafts and said second end of each said connecting rods being rotationally connected to respective said crank pins, the distance between said crank shafts axes, the length of said connecting rods, the position of said pivotal connecting means in relation to said translational means and said predetermined diameter of said orbital paths and the construction and arrangement being such that in motion the ratio of the length of each said strokes to said predetermined diameter is at least 1.1 to 1.

BRIEF DESCRIPTION OF THE DRAWINGS

One preferred form of the invention and modifications thereof will now be described with reference to the accompanying drawings in which.

MODES FOR CARRYING OUT THE INVENTION

Figure 1:
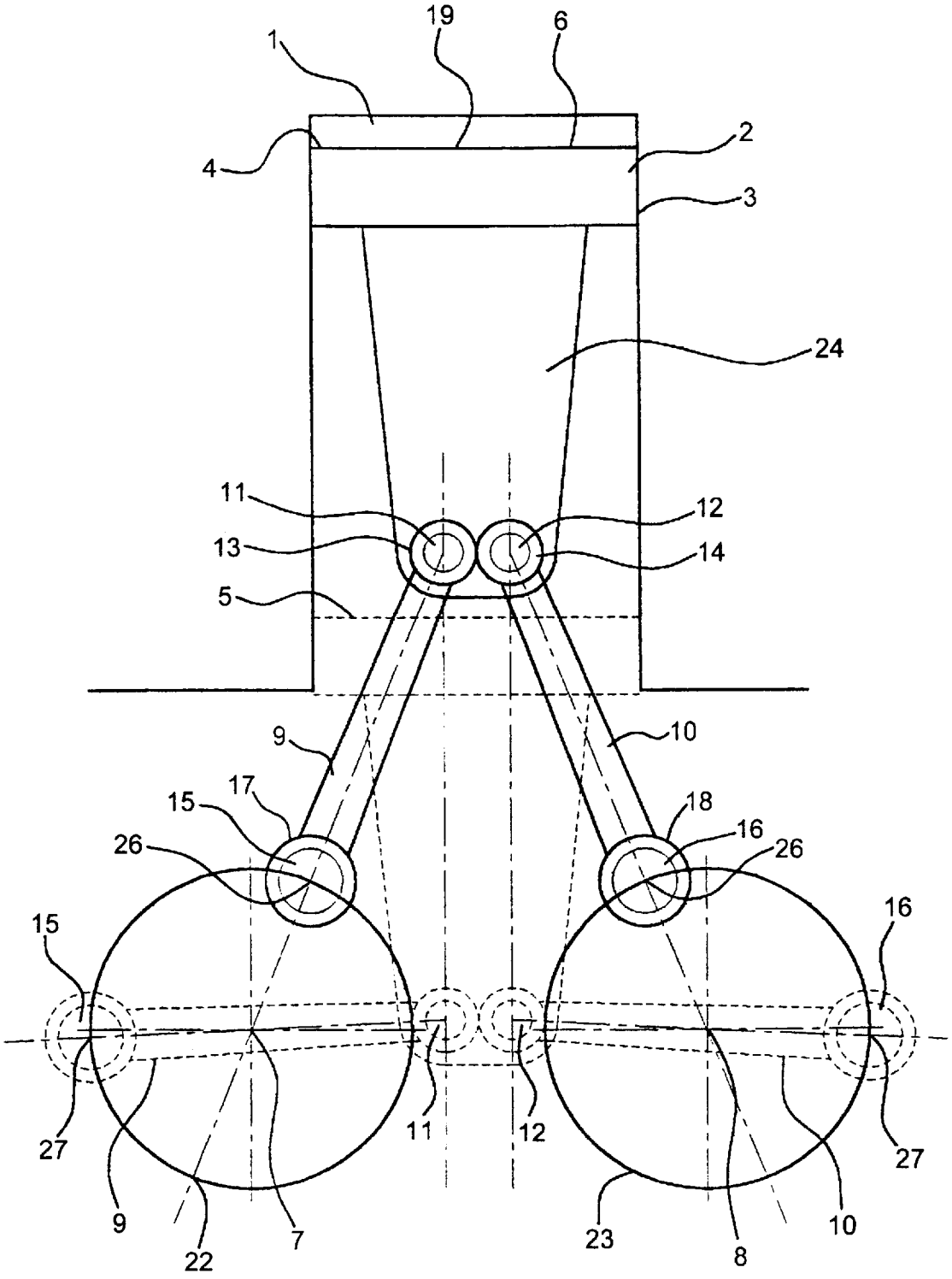
FIG. 1 is a cross sectional view through a reciprocating machine having a cylinder, piston and kinematic chain in accordance with a preferred embodiment of this invention.

As shown in FIG. 1, a preferred form of the invention comprises a cylinder 1 in which a translational means in the form of a piston head forming part of a piston 2 cyclically reciprocates within the cylinder wall 3 in the known way. The piston head is preferably only of a thickness such as to accommodate other fittings eg. piston rings.

The piston 2 is designed to travel a first stroke of predetermined length of a cyclical reciprocating motion forward between a first position 4 and a second position 5 and back between position 5 and position 4 during a second stroke. Additional conventional apparatus such as sealing rings to seal the piston 2 adjacent the cylinder wall 3 can be provided as desired, but it is to be noted that only the short piston head need be guided by the cylinder wall 3, thus reducing the friction area compared with a conventional piston.

As shown in the drawing in FIG. 1, the first position 4 for the piston 2 corresponds to a position known as top dead centre (T.D.C.) being the closest point of travel of the piston 2 towards the top of the cylinder 1. The second position 5 corresponds with bottom dead centre (B.D.C.) being the extent of travel of the piston 2 at the other end of its reciprocating motion, the first and second strokes of the piston motion being cyclically repeated in the known way.

The piston 2 is connected to a kinematic chain comprising two crank shafts, the axes of which are referenced 7 and 8, a pair of connecting rods (conrods) 9 and 10 and gudgeon or piston pins 11 and 12. In the preferred form of the invention the two crank shafts 7 and 8 are symmetrically positioned on opposed sides and each being equidistant from and normal to the center line of the cylinder 1 being also the central line of motion of the piston 2. As shown in FIG. 1, the axes of the crank shaft 7 and 8 are provided on a plane substantially transverse to the line of motion of the piston 2.

Each conrod 9 and 10 has a first small end pivotally connected to a shaped attaching means comprising an elongated piston extension 24 forming a further part of the piston 2 and by pivotal connections being the gudgeon pins 11 and 12 and small ends 13 and 14 of the conrods 9 and 10 respectively. In this embodiment of the invention the piston extension 24 is not guided by the cylinder wall 3.

Figure 2:
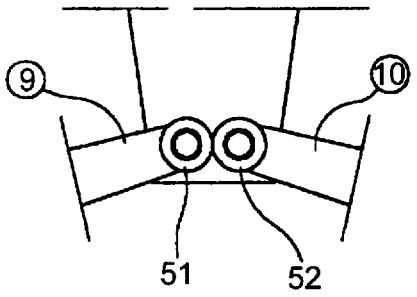
FIG. 2 is a cross sectional elevational view through a part of the machine of FIG. 1.
Figure 3:
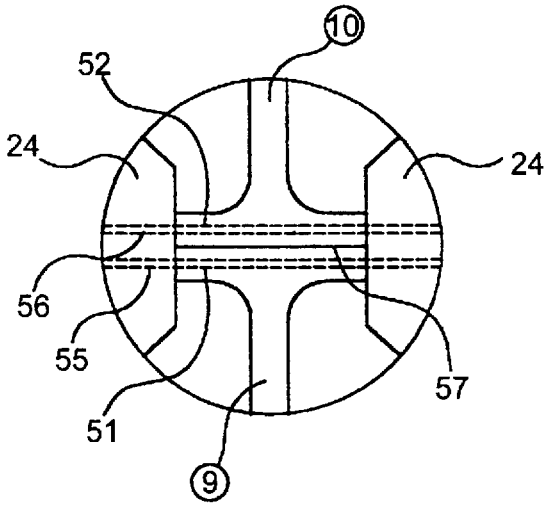
FIG. 3 is a cross sectional plan view of an alternative arrangement of the part of the machine of FIG. 2, FIGS. 4, 5, 6 are cross sectional views of further embodiments of the invention showing the effect of different dimensions and dispositions of the elements thereof.

The kinematic chain as described in this preferred form of the invention causes substantial forces to act in a direction lateral to the direction of travel of the piston 2. Therefore, to reduce the transmission of such forces, abutting means are provided between the pivotal connections. Preferably, as shown in FIGS. 2 and 3, the abutting means comprise outer cylindrical portions 51 and 52 at the small ends 13 and 14 of the conrods 9 and 10. These cylindrical portions 51 and 52 at the ends of conrods 9 and 10 are arranged to abut so that at least much of the lateral force from each of the conrods 9 and 10 is countered by an equal and opposite force transmitted through this abutting means from the other conrad and hereby reducing wear on the gudgeon pins 11 and 12 and/or between the piston 2 and the cylinder wall 3. It should be noted that as shown in FIG. 3 the cylindrical portions 51 and 52 preferably extend over the available width and arcuate portions of the conrods 9 and 10 which in use abut throughout the travel of the piston 2 and the consequential rotation of the conrods 9 and 10 with respect to each other about their respective gudgeon pin axes.

Thus in FIG. 3, the piston extension 24 has a space within which the conrods 9 and 10 are fitted such that the gudgeon pins 55 and 56 pass through the first small end of each of the conrods 9 and 10 respectively and connect into those portions of the piston extension 24 either side of the space into which the conrods 9 and 10 are fitted. The abutting of portions 51 and 52 is shown by line 57. From FIG. 3 it will be apparent that the conrods are centrally disposed in the diameter of the piston 2 and opposite to each other.

The conrods 9 and 10 have second ends which are rotationally connected to crank pins 15 and 16 on the crank shafts 7 and 8 through big ends 17 and 18 of the conrods 9 and 10 respectively. The axes of the crank pins each follow an orbital circular path 22 and 23 of a predetermined diameter.

The constructional details otherwise of the crank shafts, the cranks connecting the crank pins to the crank shaft and the connecting rods and their big ends are of well known form.

From the foregoing it will be apparent that in applying the present invention to a machine, the parameters of the elements in the kinematic chain of the invention may be varied to give the required length of stroke of the piston 2 relative to a predetermined diameter of the orbit of the axes of the crank pins 15 and 16 and for the first stroke over a required angle of rotation of the crank shafts 7 and 8.

These variations may be made in

1. The distance between the crank shafts 7 and 8.
2. The distance between the gudgeon pins 11 and 12.
3. The radial distance between the crank shaft axes and their respective crank pins ie the diameter of the orbital paths of the crank pin axes.
4. The effective lengths of the conrods.

The distance between the piston head 6 and the gudgeon pins 11 and 12 does not affect the ratio of the stroke to the diameter of the orbit of the crank pins 15 and 16 but a designer must take this parameter into consideration in making a design.

The operation of the kinematic chain incorporating the invention will be clear from the foregoing. Reciprocation of the piston 2 causes rotation of the crank shafts 7 and 8 which are interlinked to give contra rotation inwardly. According to the dimensioning and positioning of the elements of the kinematic chain the relationship between the stroke of the piston 2 and the diameter of the crank pin axes orbital paths are fixed as are the ratio of the first stroke of translations movement to the first arc of rotational movement and the ratio of the second stroke of translational movement to the second arc of rotational movement.

In the preferred form of the invention shown in FIG. 1 the parameters are:

| | |
|---|---|
| crank shaft axes spacing | 70 units |
| gudgeon pin axes spacing | 10 units |
| conrod length | 55 units |
| stroke | 73 units |
| crank pin axes orbit diameter | 50 units |

giving a ratio of stroke to crank pin axis orbit diameter of 1.46 to 1 and a first arc to second arc ratio of rotation of about 2.16 to 1 the first arc of rotation being 246° and the second arc of rotation being 114°.

Figure 4:
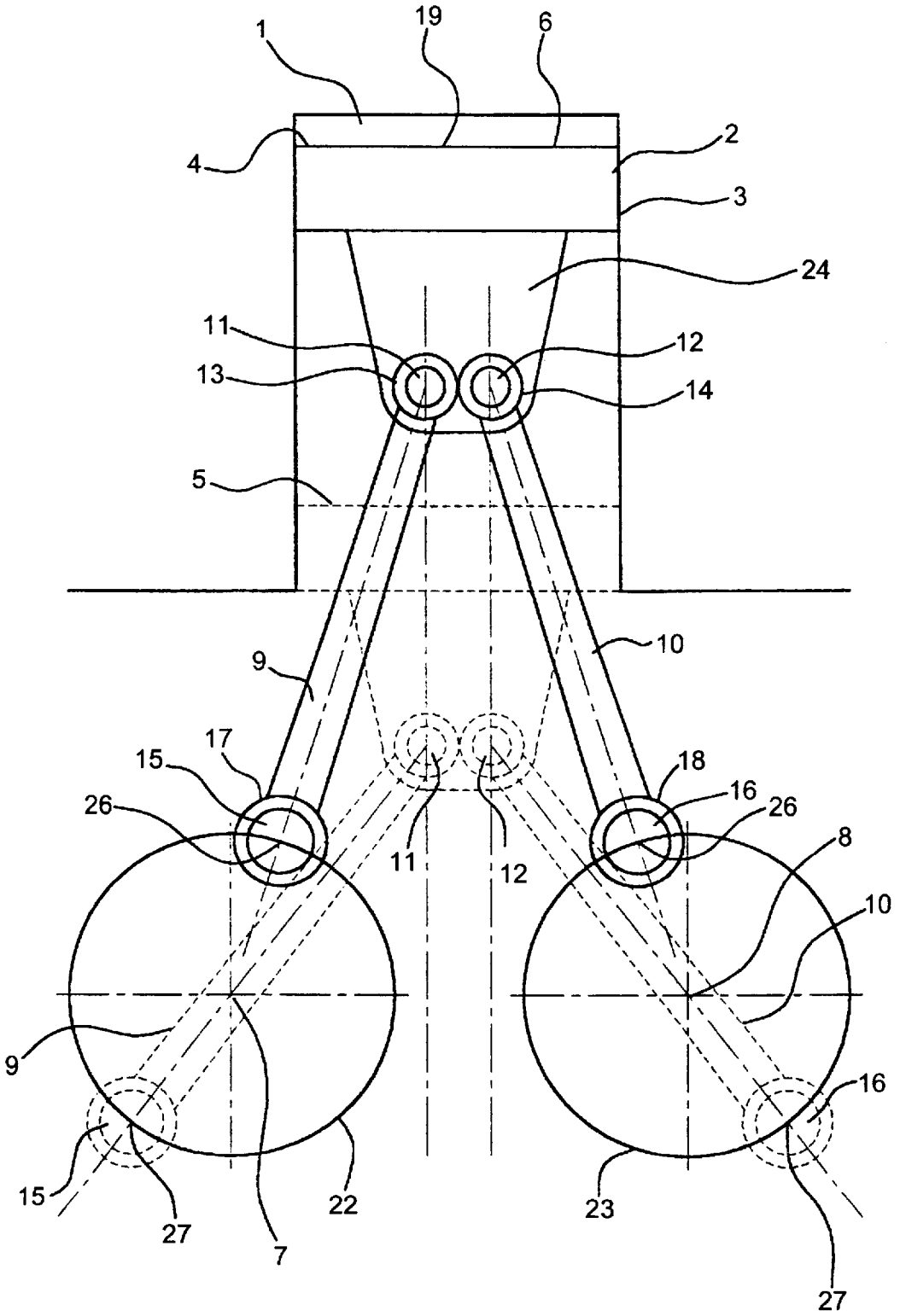
Figure 5:
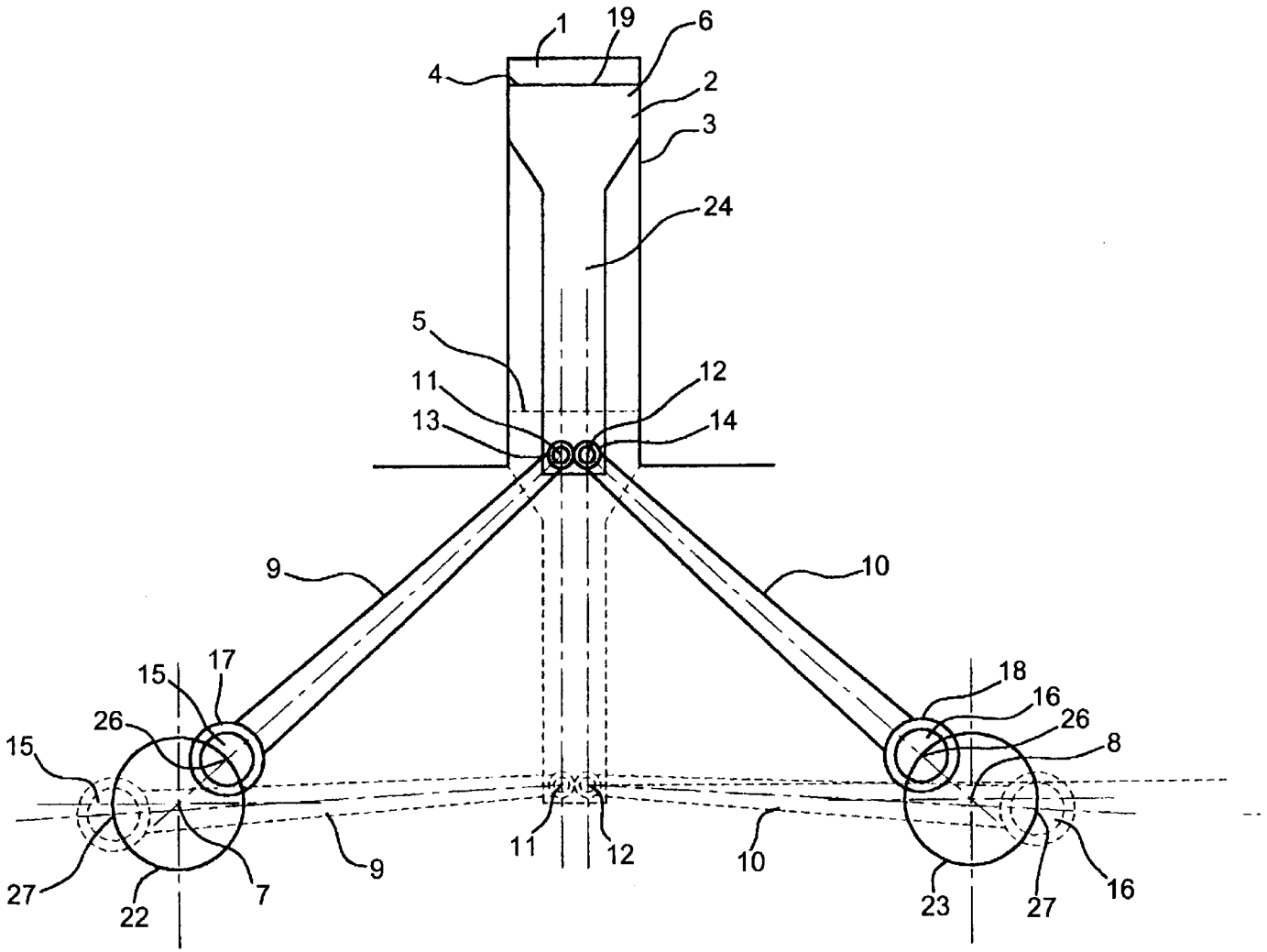
Figure 6:
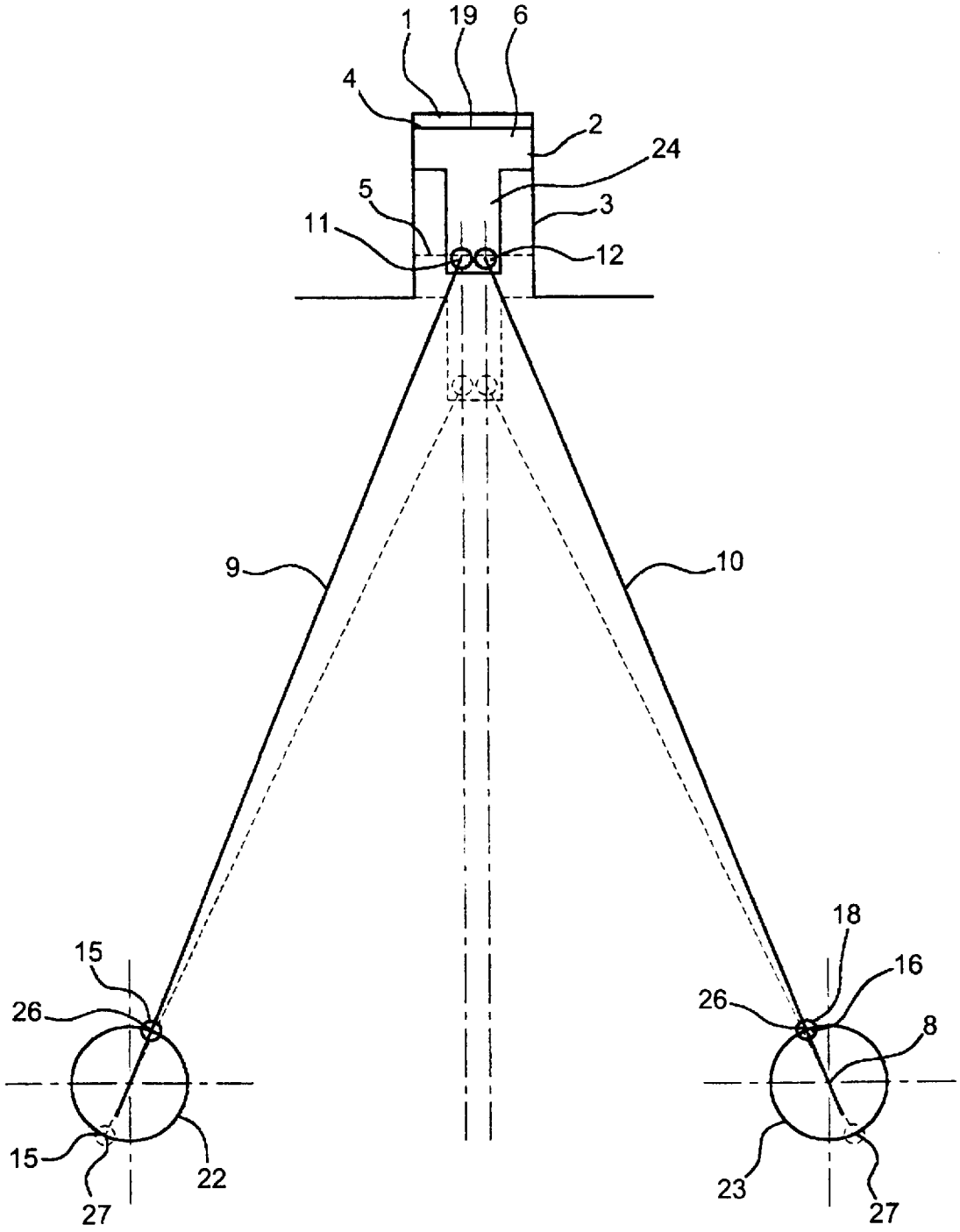

In FIGS. 4, 5 and 6, different parameters have been used in showing variation of the kinematic chain of FIG. 1.

Referring now to FIG. 4, (as in all the Figures the same reference numbers are used to refer to the same integers since only positions or dimensions have been varied) the parameters shown are:

| | |
|---|---|
| crank shaft spacing | 70 units |
| gudgeon pin axes spacing | 10 units |
| conrod length | 75 units |
| stroke | 55 units |
| crank pin axis orbit diameter | 50 units |

giving a ratio of stroke to crank pin axis orbit diameter of 1.1 to 1 and a first arc to second arc of rotation ratio of about 1.25 to 1, the first arc of rotation being 200° and the second arc of rotation being 160°.

Referring now to FIG. 5, the parameters shown are:

| | |
|---|---|
| crank shaft spacing | 121 units |
| gudgeon pin axes spacing | 4 units |
| conrod length | 68 units |
| stroke | 49.5 units |
| crank pin axis orbit diameter | 20 units |

giving a ratio of stroke to crank pin axis orbit diameter of 2.48 to 1 and a first arc to second are of rotation ratio of about 1.45 to 1, the first arc of rotation being 213° and the second arc of rotation being 147°.

A comparison between the embodiments of FIG. 1 and FIG. 5 gives ratios as follows:

| | FIG. 1 | FIG. 5 |
|---|---|---|
| stroke/orbit diameter | 1.46 | 2.48 |
| first to second arc | 2.16 | 1.45 |

These ratio differences are brought about principally because of the crank shaft spacings and one result is the variation in piston speeds and accelerations during both the first and second strokes.

It is to be noted that in FIGS. 1 and 5 when the piston 2 is at B.D.C position 5 the gudgeon pins come close but do not pass through the plane in which the crank shaft axes lie. To cyclically repeat the first and second strokes it is not possible for the gudgeon pin axes to pass the plane in which the crank shaft axes lie.

In FIG. 6 a configuration is shown in which a wide crankshaft spacing is provided but because the piston B.D.C position 5 is disposed a wide distance away, only a moderate stroke/orbit diameter is obtained.

Thus the dimensions are:

| | |
|---|---|
| crank shaft spacing | 105 units |
| conrod length | 127 units |
| stroke | 19.25 units |
| crank pin axis orbit diameter | 17.5 units |

giving a ratio of stroke to crank pin axis orbit diameter of 1.1 to 1 and a first arc to second arc of rotation ratio of about 1.04 to 1, the first arc of rotation being 184° and the second arc of rotation being 176°.

It is believed that at least some advantages of the invention will be obtained if the stroke/diameter ratio lies between 1.1 to 1 and 2.4 to 1.

As stated above in each of the embodiments the distance between the axes of the gudgeon pins 11 and 12 and the working surface 19 of the piston 2 does not affect the above ratios but enables the piston head to run clear of the orbital paths of the crank pins 15 and 16 without interference with any balance weights (not shown) or other crank shaft appendages, and similarly the piston extension 24 is shaped to avoid obstruction between moving elements.

Figure 8:
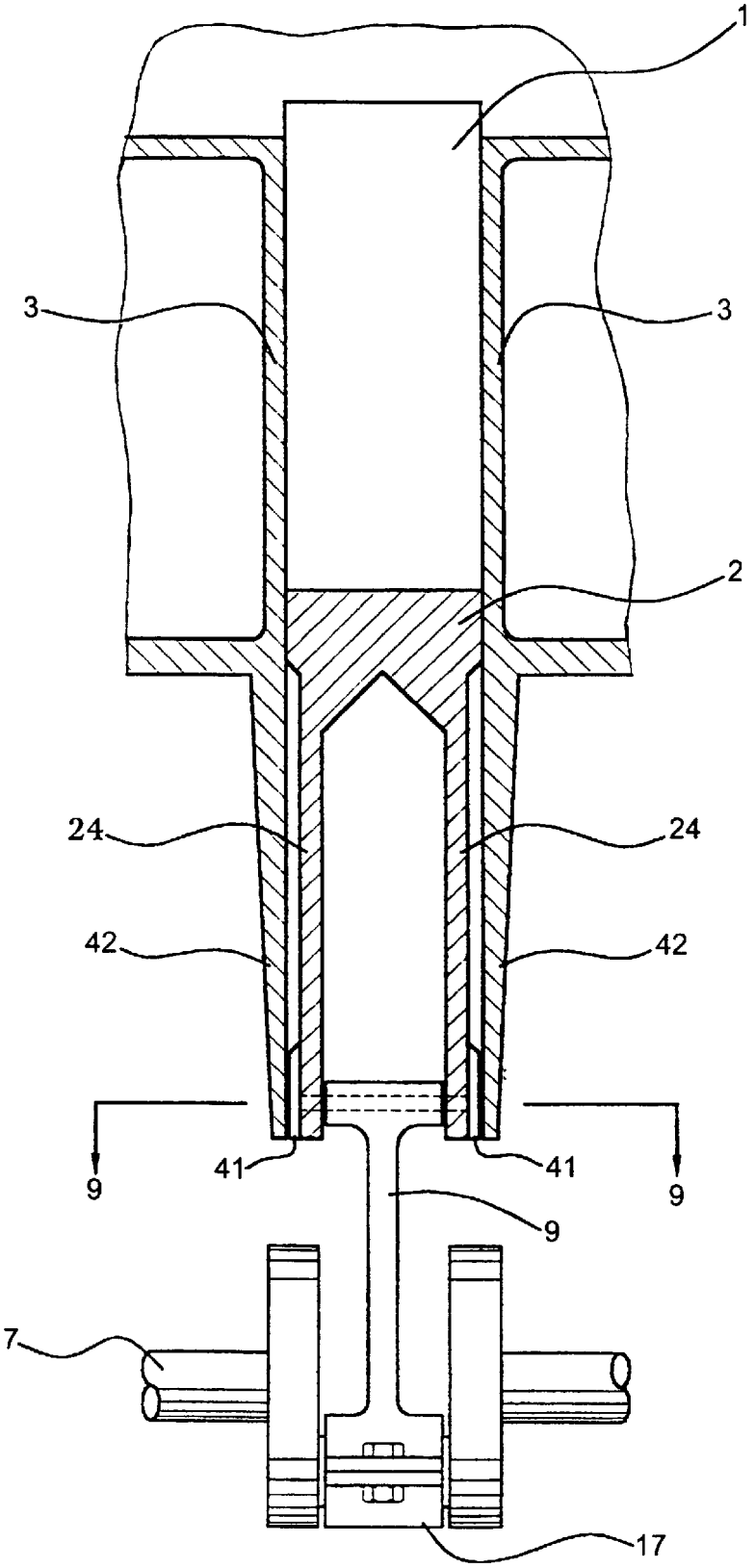
FIG. 8 is a cross sectional view of a still further embodiment of the invention showing an alternative translational means.
Figure 9:
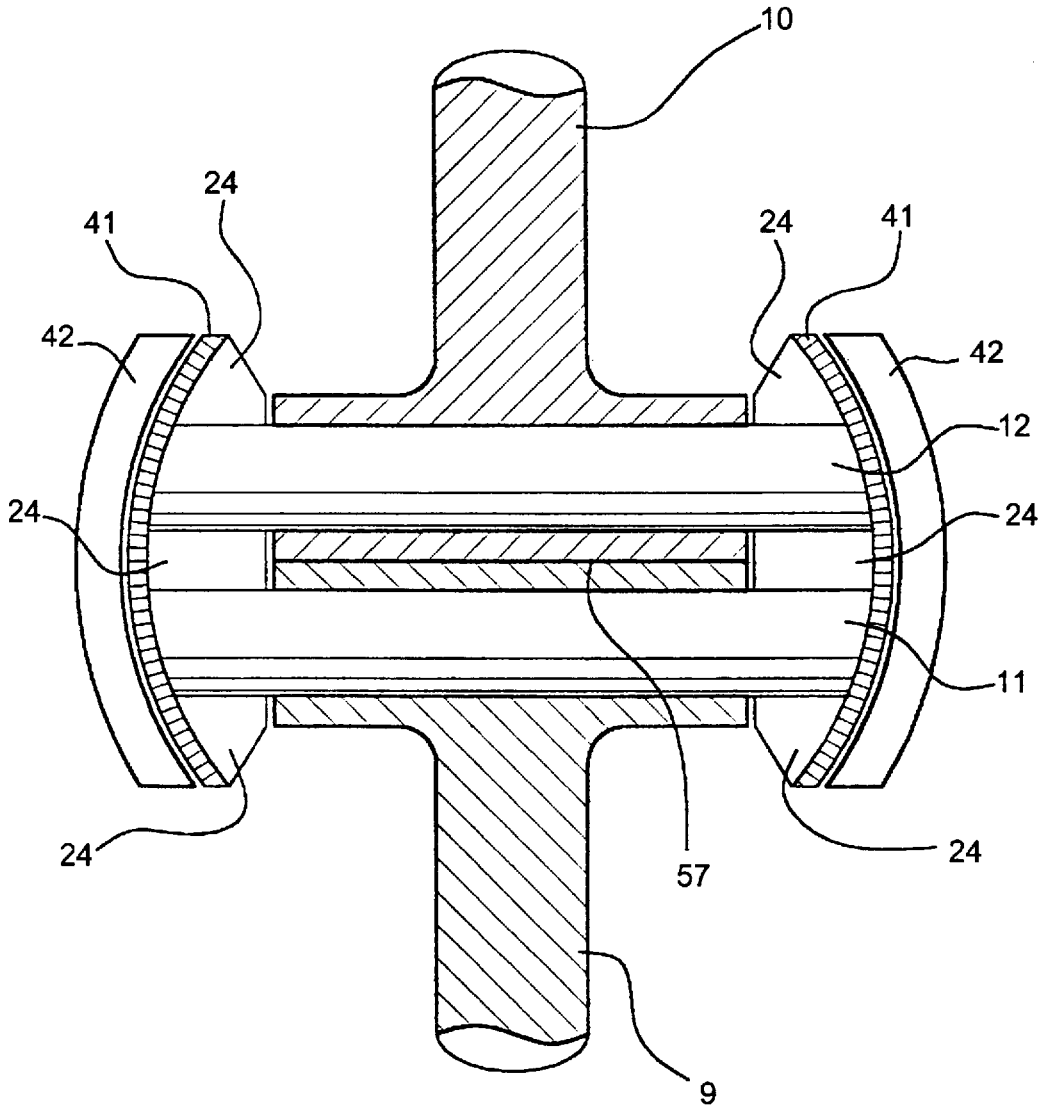
FIG. 9 is a cross section on the be 9—9 of FIG. 8.

It is not anticipated that material lateral forces will occur in a direction normal to the axes of the gudgeon pins 11 and 12 but in the event that resistance to such forces is necessary, translational guiding means are provided in a further embodiment of the invention as shown in FIGS. 8 and 9 in which the piston extension 24 carries sliding shoes 41 which slide against slides 42 which are preferably extensions of the cylinder wall 3 as shown and which are arranged parallel to the line of motion of the piston 2 and allow for clearance from eg the cranks and crank pins 15 and 16. The slides 42 are not a complete extension of the cylinder wall 3 but are spaced to allow such clearance.

As shown, the slides 41 are sliding surfaces provided in areas normal to the gudgeon pins 11 and 12.

In FIGS. 1, and 4 to 6, positions 26 and 27 relate to the positions of the crank pins 15 and 16 about the orbital paths 22 and 23 respectively when the piston 2 is at T.D.C. position 4 in the case of point 26 and at B.D.C. position 5 in respect of point 27. Preferably the pivotal connections 11 and 12 between the conrods 9 and 10 to the piston 2 are at a lesser distance or spacing from each other than the closest position achieved by the crank pins 15 and 16 as shown in the figures. With such a configuration, the conrods 9 and 10 at all times during a cycle diverge from their first ends 13 and 14 to their second ends 17 and 18. Thus the distance between the pivotal connections 11 and 12 is less than the distance between the crank pins 15 and 16 as shown, so that the conrods 9 and 10 never achieve a parallel state. Additionally as may be seen in FIGS. 1, and 4 to 6, the axes of the pivotal connections 11 and 12 follow paths parallel to but spaced away from the line of motion of the central axis of the piston 2.

In the preferred form of the invention and modifications thereof the crank pins are arranged to rotate towards each other during the first part of the first stroke, the first stroke is in a direction towards the plane of the axes of crank shafts 7 and 8, and the crankshafts are interconnected eg by gearing, to be contra-rotating. This rotation is herein referred to as having inwardly turning crank shafts. However, for some applications, outwardly turning crank shafts 7 and 8 may be beneficial. This may particularly but not solely apply to pumps or hydraulics using this form of apparatus.

Figure 7:
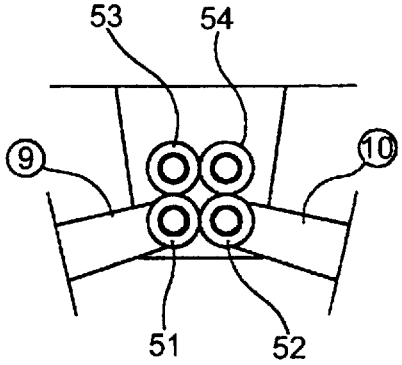
FIG. 7 is a further alternative cross sectional elevation to that part shown in FIG. 2.

In an alternative arrangement of the connections between the conrods 9 and 10 and the piston 2, as shown in FIG. 7, the cylindrical portions 51 and 52 are used to assist in transferring forces between piston 2 and the conrods 9 and 10 through the provision of rollers 53 and 54 rotating on pins fixed to the piston 2, the rollers 53 and 54 abutting the portions 51 and 52 of the conrods and assist through their own connection to the piston 2 transferring forces between the piston 2 and the conrods 9 and 10.

In FIGS. 1, and 4 to 6 the crank pin positions corresponding to T.D.C. position 4 are shown in full and the positions in B.D.C position 5 arc shown in pecked lines.

A reciprocating machine having a kinematic chain and a cylinder and piston as described may be and preferably is incorporated within an engine such as an internal combustion engine having a plurality of cylinders with a piston in each cylinder connected to both the crank shaft 7 and 8 by connecting rods as described. Furthermore, each cylinder 1 may contain inlet and outlet valves and/or ports as required to correspond with a four stroke or two stroke engine.

From the described embodiments of the invention it can be seen that a wide range of stroke/crank pin axis orbit diameter ratios can be accommodated by use of the invention. It is believed that a minimum novel such ratio is 1.1 to 1 and a maximum novel such ratio is about the above 2.48 to 1.

From the foregoing it can be seen that the invention at least in the preferred form and/or the herein described modifications in or additions thereto has many advantages, some of which are set out as follows:

1. The use of this invention in an engine allows the travel of the piston and the working length of the cylinder and the resultant cubic capacity of the swept volume of the engine for selected embodiments to be increased without increasing the orbital radius of each crank pin, thereby minimising the engine's height for a specific cubic capacity.

2. Compared with a conventional engine an additional up to say 66° of crank shaft rotation can be achieved for use during each power or combustion first stroke. The overlapping of the combustion strokes in, for example, a four cylinder four stroke engine incorporating the invention by appropriate configuration of the crank pins on the crank shaft and timing of the engine may provide a power output which approaches being continuous. Thus it is believed with some configurations at least a reduced flywheel effect need be provided.

3. Another benefit arising from the balanced forces between the piston and conrods is that the side wall 59 of the piston itself can be of reduced depth compared with a conventional piston. This is due to less length of side wall being required to keep the piston 2 straight within the cylinder 1 without material rocking. Thus the length of the cylinder 1 can be reduced as compared with the length of stroke of a piston in a conventional engine. The piston extension 24 does not necessarily have to be guided by the cylinder wall 3.

4. Should a plurality of cylinders be provided with the pistons thereof being connected to the crank shafts, the available up to 246° of crank shaft rotation under power or combustion allows two pistons connected 180° apart on the crank shaft to move in the same direction for a portion of the cycle.

5. Further benefits include a slower piston speed during combustion to increase burning time and energy extraction from a fuel and an increased actuation of the piston by the combustion forces over a wider angle of rotation of the crank shaft.

6. In a four stroke four cylinder engine, the slower piston speed and overlapping inlet strokes increase the aspiration of the engine and allow for smoother suction demands of such an engine.

7. A further benefit believed to be provided by such a configuration is the increased leverage provided to the crankshafts through the angles assumed by the conrods to each other and to the crank of the crank shaft.

8. Further in the preferred forms of this invention including such additional apparatus as the abutting ends of conrods 9 and 10, the lateral pressure from the conrods on the pivotal connections 11 and 12 is reduced to extend the life of any such bearings.

9. It is believed there is a decrease in friction between the piston and the cylinder compared with conventional engines with only a single crank shaft.

10. The invention may allow higher compression ratios to be used due to the balancing of many forces reducing the likelihood of breakage, excessive wear or other problems associated with high compression.

11. The invention also provides an engine designer with greater flexibility in the timing of an engine due to the elimination of phenomenon such as piston slap caused by timing variations in current engines.

12. In hydraulic apparatus, it may be desirable to run a further piston and cylinder on the opposed side of the crank shafts to, say, provide a hydraulic pump, powered by the primary piston 2 and cylinder 1 as described in this invention. A direct connection between the pistons is possible to provide the drive from the primary piston as shown to the second piston (not shown) pumping the hydraulics.

What is claimed is:

1. A reciprocating machine including a cyclical kinematic chain in which power is transferred between translational and rotational motion, said kinematic chain including a translational means cyclically reciprocatable along a line of motion through a first stroke between a first position and a second position and through a second stroke from said second position back to said first position, said kinematic chain having rotational means in the form of a pair of crank shafts having axes substantially symmetrically disposed on opposite sides of and normal to said line of motion of said translational means, said translational means having a pair of pivotal connecting means the axes of which are parallel and said axes in motion follow paths parallel to said line of motion, said crank shafts each having a crank pin the axis of which follows an orbital path of predetermined diameter in motion, a pair of connecting rods, each having a first end and a second end, the first end of each connecting rod being connected by said pivotal connecting means through attaching means to said translational means such that said connecting rods never achieve a parallel state, axes of said pivotal connecting means being disposed between said translational means and a line between the axes of said crank shafts and said second end of each of said connecting rods being rotationally connected to respective said crank pins, the distance between said crank shafts axes, the length of said connecting rods, the positioning of said pivotal connecting means in relation to said translational means and said predetermined diameter of said orbital paths and the construction and arrangement being such that in motion the ratio of the length of each of said strokes to the predetermined diameter is at least 1.1 to 1.

2. A reciprocating machine as claimed in claim 1 wherein said translational means comprises a piston head reciprocatable in a cylinder.

3. A reciprocating machine as claimed in claim 1 wherein abutting means are provided between said pivotal connections arranged to transmit forces between said pivotal connection from one to the other during motion of said translational means.

4. A reciprocating machine as claimed in claim 3 wherein said abutting means comprise parts of each of said pivotal connections of said connecting rods having cylindrical outer surfaces which abut each other during said motion.

5. A reciprocating machine as claimed in claim 1 wherein said crank pins rotate towards each other during a first part of said first stroke and said first stroke is in a direction towards said crankshafts.

6. A reciprocating machine as claimed in claim 1 wherein said attaching means comprise a translational means extension on which said pivotal connections are mounted remotely from said translational means.

7. A reciprocating machine as claimed in claim 1 wherein the distance between the axes of said pivotal connections is less than the closest distance achieved between the respective axes of said crank pins during orbiting of said crank pins.

8. A reciprocating machine as claimed in claim 7 wherein said closest distance between said axes of said crank pins is between twice and twenty times the distance between the axes of said pivotal connections.

9. A reciprocating machine as claimed in claim 1 wherein said crank pins orbit through an angular rotation between 183° and 246° during said first stroke of said piston and a correspondingly lesser rotation during said second stroke so that power transference occurs over a corresponding proportion of the time taken by each stroke.

10. A reciprocating machine as claimed in claim 1 wherein said ratio of the length of said stroke to said predetermined diameter is selected to be between 1.1 to 1 and 2.48 to 1.

11. A reciprocating machine as claimed in claim 1 wherein said ratio of the length of said stroke to said predetermined diameter is selected to be between 1.2 to 1 and 2.4 to 1.

12. A machine as claimed in claim 1 which comprises an engine having one or more cylinders.

13. A machine as claimed in claim 12 wherein said engine is an internal combustion engine.

14. A reciprocating machine including a cyclical kinematic chain in which power is transferred between translational and rotational motion, said kinematic chain including a translational means cyclically reciprocatable along a line of motion through a first stroke between a first position and a second position and through a second stroke from said second position back to said first position, said kinematic chain having rotational means in the form of a pair of crank shafts having axes substantially symmetrically disposed on opposite sides of and normal to said line of motion of said translational means, said translational means having a pair of pivotal connecting means the axes of which are parallel and said axes in motion follow paths parallel to said line of motion, said crank shafts each having a crank pin the axis of which follows an orbital path of predetermined diameter in motion, a pair of connecting rods, each having a first end and a second end, the first end of each connecting rod being connected by said pivotal connecting means through attaching means to said translational means, axes of said pivotal connecting means being disposed between said translational means and a line between the axes of said crank shafts and said second end of each of said connecting rods being rotationally connected to respective said crank pins, the distance between said crank shafts axes, the length of said connecting rods, the positioning of said pivotal connecting means in relation to said translational means and said predetermined diameter of said orbital paths and the construction and arrangement being such that in motion the ratio of the length of each of said strokes to the predetermined diameter is at least 1.1 to 1, and translational guiding means being provided between sliding shoes on said attaching means and fixed slide bars arranged parallel to but spaced apart from said line of motion.

* * * * *